United States Patent [19]

Moore

[11] Patent Number: 4,989,288

[45] Date of Patent: Feb. 5, 1991

[54] SWEEPING AND DUSTING APPARATUS

[76] Inventor: Terry D. Moore, 2415 Hinton Rd., Dacula, Ga. 30211

[21] Appl. No.: 473,348

[22] Filed: Feb. 1, 1990

Related U.S. Application Data

[63] Continuation-in-part of Ser. No. 381,014, Jul. 17, 1989.

[51] Int. Cl.[5] ..... A47L 1/02

[52] U.S. Cl. ..... 15/98; 15/49.1; 15/78

[58] Field of Search ..... 15/49.1, 50.1, 83, 78, 15/98

[56] References Cited

U.S. PATENT DOCUMENTS

| | | | |
|---|---|---|---|
| 2,268,519 | 12/1941 | Teager | 15/78 |
| 3,732,590 | 5/1973 | Horst | 15/49.1 |
| 4,709,436 | 12/1987 | Berfield et al. | 15/83 X |
| 4,716,621 | 1/1988 | Zolii | 15/83 X |
| 4,747,174 | 5/1988 | Hightower | 15/49.1 X |

*Primary Examiner*—Paul T. Sewell
*Assistant Examiner*—Beth Anne C. Cicconi
*Attorney, Agent, or Firm*—James B. Middleton

[57] ABSTRACT

Dust mops are fixed to a carrier, the carrier being receivable on the forks of a fork lift. The forks can be used to position the mops with respect to the floor, and the mops are carried on pivoted arms so the mops float for proper pressure even with some variation in height of the carrier. The mops are arranged with one laterally disposed, and two others angled to direct dirt and debris towards the first. Connectors on each arm fixed the conventional mop frame to the arm.

10 Claims, 2 Drawing Sheets

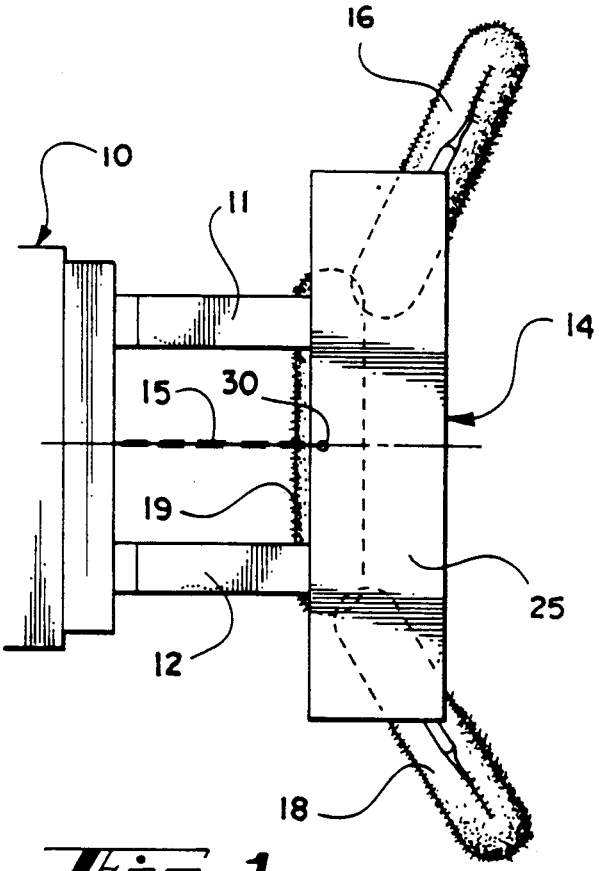
Fig_1
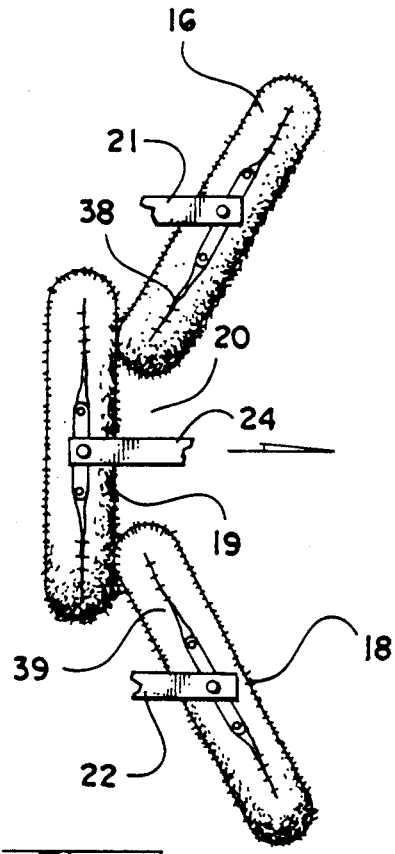
Fig_2
Fig_3
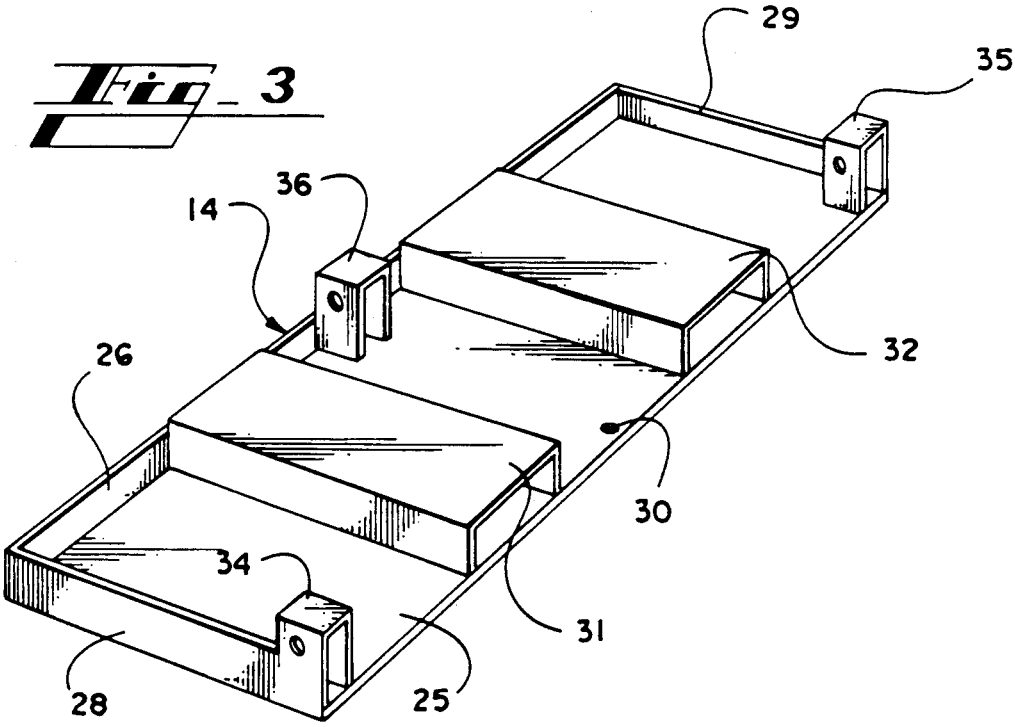

SWEEPING AND DUSTING APPARATUS

CROSS-REFERENCE TO RELATED APPLICATION

This application is a continuation-in-part of the copending application of the same inventor filed July 17, 1989 under Ser. No. 381,014 titled "Carrier for Dust Mops".

INFORMATION DISCLOSURE STATEMENT

In warehouses and the like, dust and dirt are common problems that are normally dealt with by sweeping the floor. It will be understood, however, that the floor space to be swept tends to be rather extensive so that sweeping by hand is economically unfeasible except for extremely small warehouses. To solve the problem in large warehouses, the prior art has provided a self powered sweeper that typically utilizes rotating brushes to move dirt inwardly, towards the sweeper, and frequently utilizes vacuum means to assist in lifting the dirt and debris from the floor. While these self powered sweepers are capable of removing a good bit of dirt and debris from the floor, it will be understood by those skilled in the art that a considerable amount of dust is stirred up and placed into the air because of the agitation by the brushes. Having dust in the air is undesirable from the standpoint of the workers in the warehouse, and it is further undesirable in that the dust will settle on the merchandise in the warehouse. The usual alternative is a manually pushed dust mop, which is not practical for a warehouse of any considerable size.

One prior art effort at solving the above mentioned problems comprised the mounting of a plurality of dust mops on a frame to be carried by a fork lift. While this constituted an improvement over the prior arrangements, the mounting of the dust mops was insecure so that the mops were likely to become separated from the carrier. Also, the dust mops were positioned parallel to one another and lateral of the fork lift, which is not effective in sweeping a floor.

SUMMARY OF THE INVENTION

This invention relates generally to cleaning apparatus, and is more particularly concerned with a sweeping and dusting means to be carried by a fork lift or the like.

The present invention provides a carrier selectively receivable on the forks of a conventional fork lift, the carrier mounting a plurality of dust mops. The dust mops are angularly oriented for receiving and trapping dirt and debris as the dust mops move across the floor. The angular orientation of the dust mops is held resiliently to allow deviation in the event a mop strikes an obstruction.

In the preferred embodiment of the present invention, the dust mops float with respect to the carrier to allow substantially uniform pressure of the dust mop against the floor without critical height adjustment of the forks of the fork lift.

BRIEF DESCRIPTION OF THE DRAWINGS

These and other features and advantages of the present invention will become apparent from consideration of the following specification when taken in conjunction with the accompanying drawings in which:

FIG. 1 is a top plan view showing a cleaning apparatus made in accordance with the present invention, the apparatus being carried on the forks of a conventional fork lift;

FIG. 2 is a view similar to FIG. 1 with the carrier removed and showing the plurality of dust mops;

FIG. 3 is a perspective view showing the bottom of the carrier illustrated in FIG. 1;

DETAILED DESCRIPTION OF THE EMBODIMENT

Figure 4:
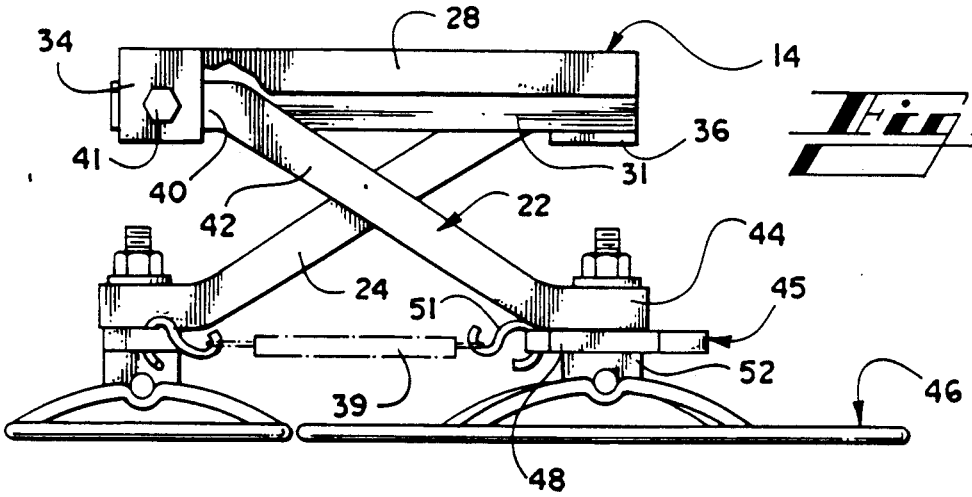
FIG. 4 is an enlarged side elevational view of the cleaning apparatus shown in FIG. 1.

Referring now more particularly to the drawings, and to that embodiment of the invention here chosen by way of illustration, FIG. 1 illustrates a conventional industrial truck designated at 10 having forks 11 and 12 extending forwardly therefrom. The carrier of the present invention, designated generally at 14, is received on the ends of the forks 11 and 12, and there is a chain 15 fixed to the carrier 14 and to the industrial truck 10. While the chain 15 may not be required, it does provide some safety to prevent the carrier 14 from being inadvertently removed from the forks 11 and 12.

The carrier 14 mounts a plurality of dust mops indicated at 16, 18 and 19. It will be seen that the mops 16, 18 and 19 are arranged with the mop 19 extending substantially transversely of the industrial truck 10, and the mops 16 and 18 extending angularly outwardly from the forward side of the mop 19. This arrangement is shown somewhat in the broken line representation in FIG. 1, but is illustrated more clearly in FIG. 2. Because of the angular arrangement shown, it will be understood that the dust mops 16 and 18 will sweep a wide swath, and the angular arrangement will cause dirt and debris to move inwardly and be retained in the area designated at 20 between the dust mops 16 and 18 and in front of the dust mop 19.

The above identified copending application discloses an arrangement very similar to that shown in FIGS. 1 and 2 of the drawings, and that disclosure is incorporated herein by reference. The copending application discloses an arrangement that is workable, but the individual dust mops are fixed in the vertical direction with respect to the carrier. The angular orientation of the three mops is the same, and the resilient retention in that orientation is the same.

In FIG. 2 of the drawings, it will be noticed that each of the mops 16, 18 and 19 is shown as carried by an arm, fragmentarily shown. Thus, the mop 16 is carried at the end of an arm 21, the mop 18 is carried on an arm 22 and the mop 19 is carried on an arm 24. These arms 21, 22 and 24 will be discussed in more detail hereinafter.

Looking next at FIG. 3 of the drawings, the carrier 14 includes an upper deck 25 having a front skirt 26 and side skirts 28 and 29. Generally centrally of the rear edge of the upper deck 25, there is a hole 30 to receive a hook or the like for receipt of the chain 15.

Fixed to the bottom side of the upper deck 25 is a pair of sleeves 31 and 32. It will be noticed that the rear ends of the sleeves 31 and 32 are open to allow the forks 11 and 12 to be inserted therein. The forward ends of the sleeves 31 and 32 are closed to limit rearward movement of the carrier 14 with respect to the forks 11 and 12.

Generally at the rear edge of the deck 25, and integral with the skirts 28 and 29, there are arm brackets 34 and 35. Centrally of the upper deck 25, and adjacent to the forward edge of the upper deck 25, there is a third bracket 36. All of the brackets 34, 35 and 36 are substantially identical, so only one will be described in detail.

Looking briefly at FIG. 2 of the drawings, it will be observed that each of the three dust mops 16, 18 and 19 includes a connector that has an elongate portion extending generally along the centerline of the dust mop. As is shown in FIG. 2 of the drawings, a spring extends between one end of the connector for the mop 16 and the connector for the mop 19, and another spring extends between the connector for the mop 19 and the connector for the mop 18. The springs, designated at 38 and 39 will be of substantially equal tension, so the mop 19 has balanced forces and will remain generally transverse to the industrial truck 10 which is shown. Since there is only one spring on each of the mops 16 and 18, these mops will be angled as shown, so the inner ends of the mops 16 and 18 will substantially abut the forward edge of the mop 19.

Turning now to FIG. 4 of the drawings, the carrier 14 is shown in side elevation, so the bracket 34 is shown clearly, with the arm 22 extending therefrom. It will be seen that the arm 22 includes a generally horizontal portion 40 that is pivotally connected to the bracket 34 by a screw 41. After the horizontal portion 40, there is a downwardly angled portion 42 which terminates in a lower horizontal portion 44. The lower horizontal portion 44 carries the attachment means 45, the attachment means 45 in turn carrying the mop frame 46. As was previously mentioned, the attachment means 45 includes the elongate member 48 which receives one end of the spring 39.

With the above description in mind, it will be realized that the mop frame 46 will carry a conventional dust mop as is illustrated in FIGS. 1 and 2 of the drawings. The arm 22 can move somewhat vertically, pivoting about the screw 41; however, downward movement of the arm 22 is limited in that the end of the horizontal portion 40 will eventually contact the bracket 34. Upward movement of the arm 22 is also limited in that the arm 22 will eventually contact the upper deck 25. Between these two extreme positions, it will be noticed that the downward force on the mop frame 46 is provided by the weight of the apparatus, perhaps enhanced somewhat by the spring 39. It is important to notice that the carrier 14 can be placed at a desired height above the floor by raising or lowering the forks 11 and 12 of the industrial truck 10. The exact height from the floor is not critical since the arms, such as the arm 22, are variable without varying the pressure of the mop against the floor to any significant extent.

Thus, while the apparatus disclosed in the above identified copending application performs effectively, the fact that the mops are rigidly fixed vertically with respect to the carrier requires very careful placement of the forks of the fork lift to provide the desired downward force on the mops. The arrangement here presented constitutes an improvement in that the downward force is determined by the arms and mops.

Figure 5:
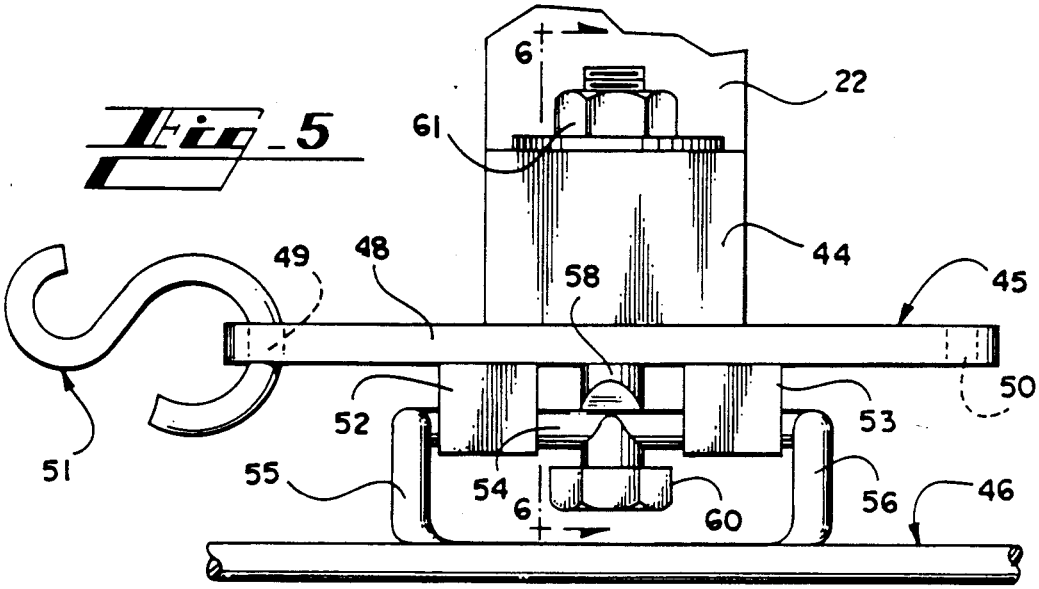
FIG. 5 is an enlarged elevational view showing the means for mounting a mop frame to the carrier arm; and, FIG. 6 is a cross-sectional view taken substantially along the line 6—6 in FIG. 5.
Figure 6:
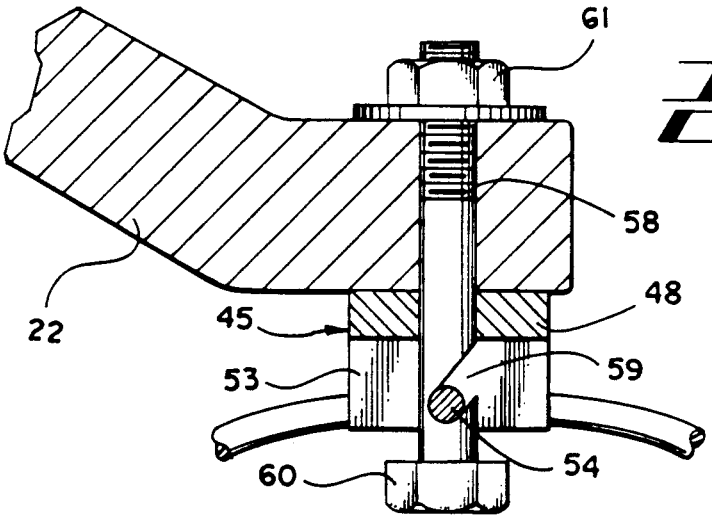

FIGS. 5 and 6 of the drawings show the attachment means 45 in more detail. The attachment means 45 includes the elongate member 48 which has holes 49 and 50 in opposite ends thereof. The holes 49 and 50 receive hooks 51 or the like to connect the spring 39 to adjacent attachment means.

Centrally of the elongate member 48, and depending therefrom, there are spaced lugs 52 and 53. Each of the lugs 52 and 53 defines a notch therein for receiving the pintle 54 of the mop frame 46. Those skilled in the art will realize that the conventional mop frame 46 includes a pair of arches 55 and 56 connected by the pintle 54. As a result, by adequately clamping the pintle 54, one adequately supports the mop frame 46.

To retain the pintle 54 within the notches of the lugs 52 and 53, a bolt 58 extends vertically through the elongate member 45, and between the lugs 52 and 53. As is best shown in FIG. 6, the bolt 58 defines a notch 59 for receiving the pintle 54. It will be seen that the bolt 58 includes the conventional head 60 on one end, and a nut 61 threaded onto the opposite end. Thus, the bolt 58 serves to hold the attachment means 45 to the arm 22, and to hold the mop frame 46 to the attachment means 45. The use of the single bolt 58 also allows the mop frame 46 and attachment means 45 to pivot with respect to the arm 22 to provide for the mounting arrangement described above.

It will therefore be seen that the apparatus of the present invention provides a sweeping means whereby a plurality of dust mops can be selectively carried on the forks of a fork lift, or other industrial truck means. The individual dust mops are arranged to collect dirt and debris and to carry the material along so it can be removed from the floor rather than to require additional passes to remove the material. With the arms 21, 22 and 24 arranged for floating with respect to the floor, there is considerable leeway so the carrier 14 can be positioned at approximately the desired height, and the individual dust mops 16, 18 and 19 will engage the floor with just sufficient pressure to provide the desired sweeping action.

Utilizing the apparatus of the present invention, the floor will be adequately swept and dusted, but there is no agitation sufficient to raise a cloud of dust and cause dirt and dust to be airborne.

Since virtually every warehouse has at least one fork lift or similar industrial truck, it will be understood that the apparatus of the present invention can be readily adapted for use without investment in additional expensive equipment. The dust mops 16, 18 and 19 are completely conventional so that, as the mops themselves wear out, replacement mops can be obtained and placed on the existing mop frames such as the mop frame 46.

It will therefore be understood by those skilled in the art that the particular embodiment of the invention here presented is by way of illustration only, and is meant to be in no way restrictive; therefore, numerous changes and modifications may be made, and full use of equivalents resorted to, without departing from the spirit or scope of the invention as outlined in the appended claims.

What is claimed is:

1. Sweeping apparatus, for use with an industrial truck, said sweeping apparatus including a carrier selectively carried by the industrial truck for movement over a floor in a given direction, a plurality of dust mops mounted on said carrier for movement with said carrier, a first dust mop of said plurality of dust mops being disposed transversely of said carrier and transversely to said given direction, a second dust mop of said plurality of dust mops being angularly disposed with respect to said given direction, a first end of said second dust mop being adjacent to said first dust mop and a second end of said second dust mop being forward of said first dust mop, a third dust mop of said plurality of dust mops being angularly disposed with respect to said given direction, a first end of said third dust mop being adjacent to said first dust mop and a second end of said third dust mop being forward of said first dust mop, and spring means for resiliently maintaining said angular disposition of said second dust mop and said third dust mop.

2. Sweeping apparatus as claimed in claim 1, said spring means including a first spring fixed to one side of said second dust mop and to the adjacent side of said first dust mop, and a second spring fixed to one side of said third dust mop and to the adjacent side of said first dust mop, said second dust mop and said third dust mop being on opposite sides of said first dust mop.

3. Sweeping apparatus as claimed in claim 1, said carrier having a front edge, and a rear edge parallel to said front edge, and first and second ends connecting said front and rear edges, said apparatus further including a plurality of arms, a first arm pivot adjacent and parallel to said front edge of said carrier, a first arm of said plurality of arms carried by said first arm pivot, said first dust mop being located adjacent to said rear edge of said carrier, said first arm extending for connection to said first dust mop, a second arm pivot adjacent and parallel to said rear edge of said carrier and adjacent to said first end, a second arm of said plurality of arms carried by said second arm pivot, said second dust mop being located adjacent to said front edge of said carrier, said second arm extending for connection to said second dust mop, a third arm pivot adjacent and parallel to said rear edge of said carrier and adjacent to said second end, a third arm of said plurality of arms carried by said third arm pivot, said third dust mop being located adjacent to said front edge of said carrier, said third arm extending for connection to said third dust mop.

4. Sweeping apparatus as claimed in claim 3, and further including a plurality of connecting means, each connecting means of said plurality of connecting means serving to connect one arm of said plurality of arms to one dust mop of said plurality of dust mops, each connecting means including an elongate member extending parallel to a dust mop, said elongate member defining holes in the ends thereof, a pair of lugs extending downwardly from said elongate member, said pair of lugs defining notches therein, said dust mop including a pintle, said pintle being receivable in said notches in said lugs, and a screw extending through said elongate member, said screw defining a hook for engaging said pintle, said screw extending through said arm for fixing said dust mop to said arm.

5. Sweeping apparatus as claimed in claim 4, said spring means including a first spring extending between said second dust mop and said first dust mop, a hook engaging one of said holes in said elongate member of said second dust mop, and a hook engaging one of said holes in said elongate member of said first dust mop, said first spring extending between said hooks.

6. In combination, a fork lift comprising an industrial truck, and a pair of forks extending forwardly therefrom, and sweeping apparatus, said sweeping apparatus comprising a carrier and a plurality of dust mops mounted on said carrier, said carrier including sleeve means for receiving said forks, and means for mounting said plurality of dust mops with respect to said carrier, said plurality of dust mops including a first dust mop disposed transversely of said industrial truck, a second dust mop forward of said first dust mop and angularly disposed with respect thereto, and a third dust mop forward of said first dust mop and angularly disposed with respect thereto, said second dust mop and said third dust mop being at opposite sides of said forks, the inner adjacent ends of said second dust mop and said third dust mop being adjacent to the forward side of said first dust mop, the outer ends of said second dust mop and said third dust mop being forward of said inner ends.

7. The combination as claimed in claim 6, and further including spring means for resiliently maintaining said angular disposition of said second dust mop and said third dust mop, said spring means including a first spring fixed to one side of said second dust mop and to the adjacent side of said first dust mop, and a second spring fixed to one side of said third dust mop and to the adjacent side of said first dust mop, said second dust mop and said third dust mop being on opposite sides of said first dust mop.

8. The combination as claimed in claim 7, said carrier having a front edge, and a rear edge parallel to said front edge, and first and second ends connecting said front and rear edges, said apparatus further including a plurality of arms, a first arm pivot adjacent and parallel to said front edge of said carrier, a first arm of said plurality of arms carried by said first arm pivot, said first dust mop being located adjacent to said rear edge of said carrier, said first arm extending for connection to said first dust mop, a second arm pivot adjacent and parallel to said rear edge of said carrier and adjacent to said first end, a second arm of said plurality of arms carried by said second arm pivot, said second dust mop being located adjacent to said front edge of said carrier, said second arm extending for connection to said second dust mop, a third arm pivot adjacent and parallel to said rear edge of said carrier and adjacent to said second end, a third arm of said plurality of arms carried by said third arm pivot, said third dust mop being located adjacent to said front edge of said carrier, said third arm extending for connection to said third dust mop.

9. The combination as claimed in claim 8, and further including a plurality of connecting means, each connecting means of said plurality of connecting means serving to connect one arm of said plurality of arms to one dust mop of said plurality of dust mops, each connecting means including an elongate member extending parallel to a dust mop, said elongate member defining holes in the ends thereof, a pair of lugs extending downwardly from said elongate member, said pair of lugs defining notches therein, said dust mop including a pintle, said pintle being receivable in said notches in said lugs, and a screw extending through said elongate member, said screw defining a hook for engaging said pintle, said screw extending through said arm for fixing said dust mop to said arm.

10. The combination as claimed in claim 9, said spring means including a first spring extending between said second dust mop and said first dust mop, a hook engaging one of said holes in said elongate member of said second dust mop, and a hook engaging one of said holes in said elongate member of said first dust mop, said first spring extending between said hooks.

* * * * *